US008884162B2

(12) United States Patent
Hayama

(10) Patent No.: US 8,884,162 B2
(45) Date of Patent: Nov. 11, 2014

(54) CONDUCTIVE ELEMENT AND METHOD FOR MANUFACTURING THE SAME

(76) Inventor: Frank Hayama, Tokyo (JP)

( * ) Notice: Subject to any disclaimer, the term of this patent is extended or adjusted under 35 U.S.C. 154(b) by 246 days.

(21) Appl. No.: 13/404,708

(22) Filed: Feb. 24, 2012

(65) Prior Publication Data

US 2013/0056239 A1 Mar. 7, 2013

(30) Foreign Application Priority Data

Sep. 5, 2011 (TW) ..... 100131875 A

(51) Int. Cl.

| | |
|---|---|
| ***H01B 7/00*** | (2006.01) |
| ***H01B 13/00*** | (2006.01) |
| ***H01R 4/48*** | (2006.01) |
| ***H01R 11/12*** | (2006.01) |
| ***H01R 13/24*** | (2006.01) |
| ***H01R 13/33*** | (2006.01) |

(52) U.S. Cl.

CPC ..... *H01R 4/4863* (2013.01); *H01R 11/12* (2013.01); *H01R 13/2421* (2013.01); *H01R 13/33* (2013.01)

USPC ..... 174/110 R; 174/113 R; 174/68.1; 174/68.2; 439/551; 439/841; 439/739

(58) Field of Classification Search

USPC ..... 174/110 R, 113 R, 117 R, 129 B, 72 B, 174/71 B, 68.1, 68.2, 88 B; 439/578–583, 439/551, 805, 939, 682, 816, 676, 827, 828, 439/847, 745, 891, 739; 29/825; 257/690

See application file for complete search history.

(56) References Cited

U.S. PATENT DOCUMENTS

| | | | | |
|---|---|---|---|---|
| 2,584,528 | A * | 2/1952 | Alexander | 439/739 |
| 3,141,723 | A * | 7/1964 | Bonhomme | 439/847 |
| 3,268,850 | A * | 8/1966 | Bernutz | 439/745 |
| 3,754,204 | A * | 8/1973 | Raitport et al. | 439/816 |
| 7,187,074 | B2 * | 3/2007 | Uchiyama et al. | 257/690 |
| 7,976,353 | B2 * | 7/2011 | Myer et al. | 439/891 |
| 8,299,360 | B2 * | 10/2012 | Sato et al. | 174/68.2 |

FOREIGN PATENT DOCUMENTS

| | | |
|---|---|---|
| TW | I244242 | 11/2005 |

* cited by examiner

*Primary Examiner* — Angel R Estrada
(74) *Attorney, Agent, or Firm* — Steptoe & Johnson LLP

(57) ABSTRACT

A method for manufacturing a conductive element includes: providing a line segment made of a conductive material, forming a spiral portion at one end of the line segment by joining a plurality of rings, and forming a loop at the other end thereof, so that the line segment forms a conductive rod; and encasing an insulator around the conductive rod and exposing the loop. By winding the line segment, there is no need to remove any material from the line segment, and no waste material is produced, thus lowering the manufacturing cost. A conductive element is also provided.

14 Claims, 5 Drawing Sheets

CONDUCTIVE ELEMENT AND METHOD FOR MANUFACTURING THE SAME

FIELD OF THE INVENTION

The present invention relates to conductive elements, and, more particularly, to a conductive element with a conductor encased by an insulator and a method of manufacturing the conductive element.

BACKGROUND OF THE INVENTION

FIGS. 1A and 1B are diagrams illustrating an electromagnetic clip 1 disclosed by TW Patent No. 1244242. The electromagnetic clip 1 includes a conductor 10 and an insulator 11 that sheaths the conductor 10. The conductor 10 is formed by flat copper plate stamping, and has one end that is an elongated ring portion 100 for inserting a pin (not shown) therein, and the other end that is a strip element 101 with two electrically connecting parts 101*a* and 101*b*, and an extension interface 102 is positioned perpendicular to the elongated ring portion 100 between the two ends. The strip element 101 is exposed from the insulator 11 for connecting other circuits (not shown).

However, in the electromagnetic clip 1 of the prior art, the conductor 10 is formed by copper plate stamping, so copper surrounding the conductor 10 will need to be removed. As a result, most of material for making the copper plate is wasted. The cost of manufacturing is thus not economical.

Furthermore, considering an RCA socket 1' of the prior art shown in FIG. 1C, a conductor 10' is also formed by copper plate stamping, which has the same problem of material waste.

Therefore, there is a need for a salutation that overcomes this problem.

SUMMARY OF THE INVENTION

In the light of forgoing drawbacks, an objective of the present invention is to provide a method for manufacturing a conductive element, which may include: providing a line segment made of a conductive material; forming a spiral portion at one end of the line segment by joining a plurality of rings by winding, and forming a loop at the other end thereof by bending, so that the line segment forms a conductive rod; and encasing an insulator around the conductive rod and exposing the loop.

Based on the above manufacturing method, the present invention further provides a conductive element, which includes: a conductive rod integrally formed by a single line segment and having one end that is a spiral portion formed by joining a plurality of rings and the other end that is a loop; and an insulator encasing the conductive rod and exposing the loop.

Based on the conductive element of the present invention and the method for manufacturing the same, the conductive rod is formed by winding a line segment, so there is no need to remove any material, and no waste material is produced, thus having a lower manufacturing cost compared to the traditional methods.

Furthermore, since the conductive rod of the present invention is integrally formed by a single line segment, the weight of the conductive rod is reduced and is more advantageous for shipping, as compared to the traditional approaches of manufacturing conductors such as stamping or lathe cutting.

In addition, based on the conductive element of the present invention and the manufacturing method thereof, the present invention further provides specific implementations as described below.

DETAILED DESCRIPTION OF THE EMBODIMENTS

The present invention is described by the following specific embodiments. Those with ordinary skill in the art can readily understand the other advantages and functions of the present invention after reading the disclosure of this specification.

It should be noted that the structures, ratios and sizes of components shown in the attached drawings are only used for the purpose of accompanying the study of the contents disclosed in this specification, so that one with ordinary skills in the art can understand the present invention, they are not to limit the present invention in any way and have no technical meanings. Changes can be made to the structures, proportions and sizes without departing from the scope of the present invention, so long as they do not affect the effects and objectives achieved by the present invention. Terms such as "left," "right," "two," "upper surface," "a plurality of" and "a (an)" used herein are for illustration only and not to limit the scope of the present invention, changes in the relative relationships are considered as within the scope of the present invention so long as there is no substantial changes in the technical contents.

FIGS. 2A to 2E are diagrams illustrating the manufacturing of a conductor 2 according to an embodiment of the present invention.

Figure 1A:
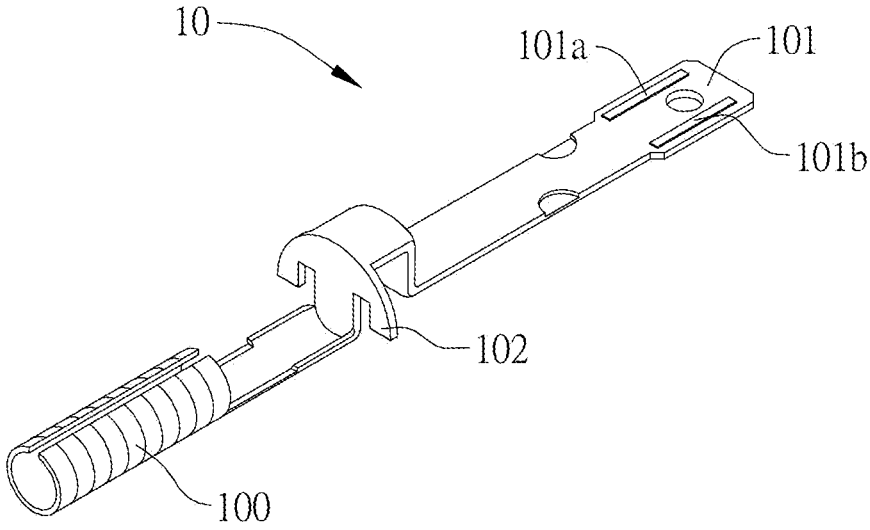
FIG. 1A (PRIOR ART)
FIG. 1A is a perspective diagram showing a conductor of a traditional electromagnetic clip formed by stamping.
Figure 1B:
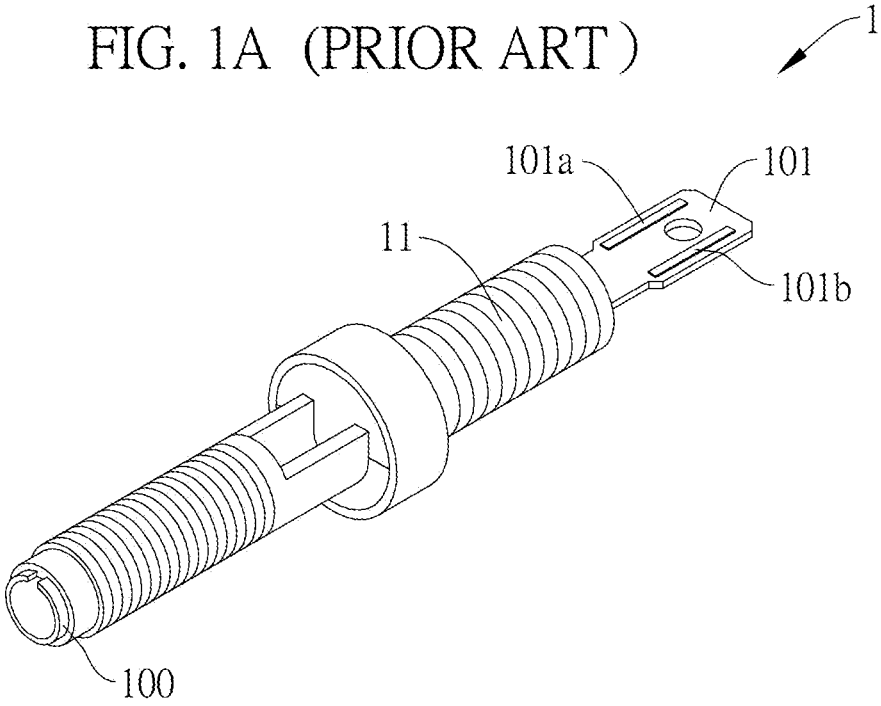
FIG. 1B (PRIOR ART)
FIG. 1B is a perspective diagram showing the traditional electromagnetic clip.
Figure 1C:
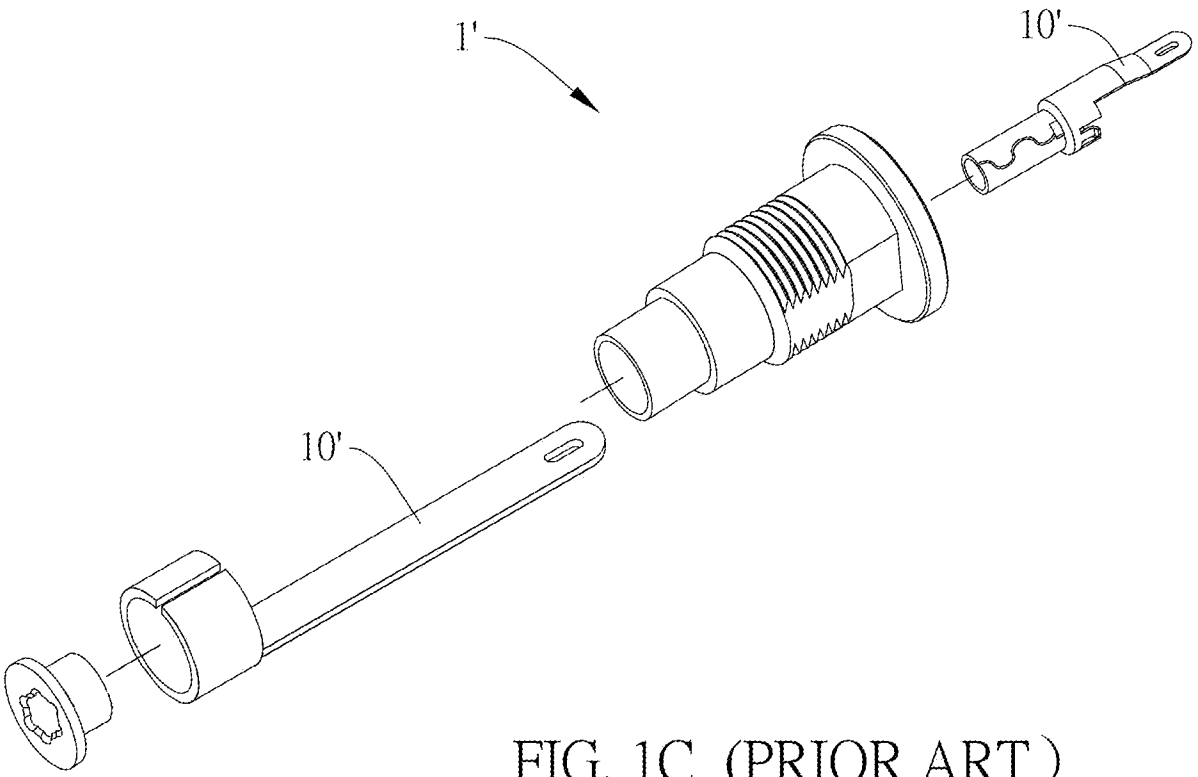
FIG. 1C (PRIOR ART)
FIG. 1C is an exploded diagram showing a traditional RCA socket.
Figure 2A:
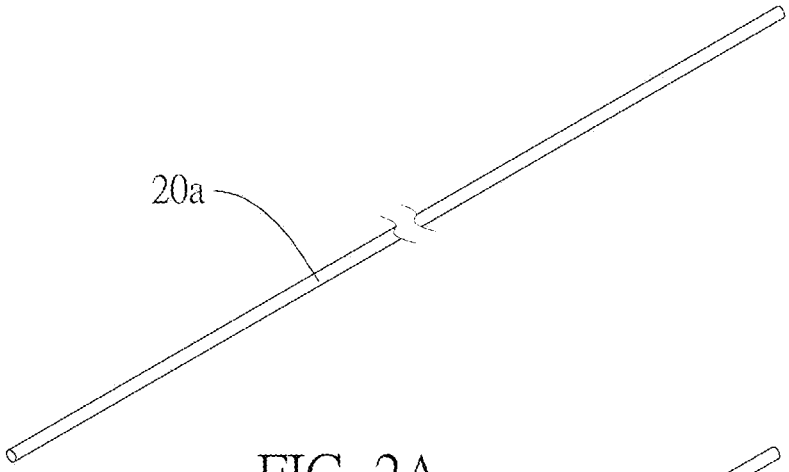
FIGS. 2A to 2E are perspective diagrams showing the manufacturing of a conductor according to an embodiment of the present invention.

As shown in FIG. 2A, first, a conductor in the form of a copper line is provided, for example. The copper line is divided into a plurality of line segments 20*a* of desired lengths.

Figure 2B:
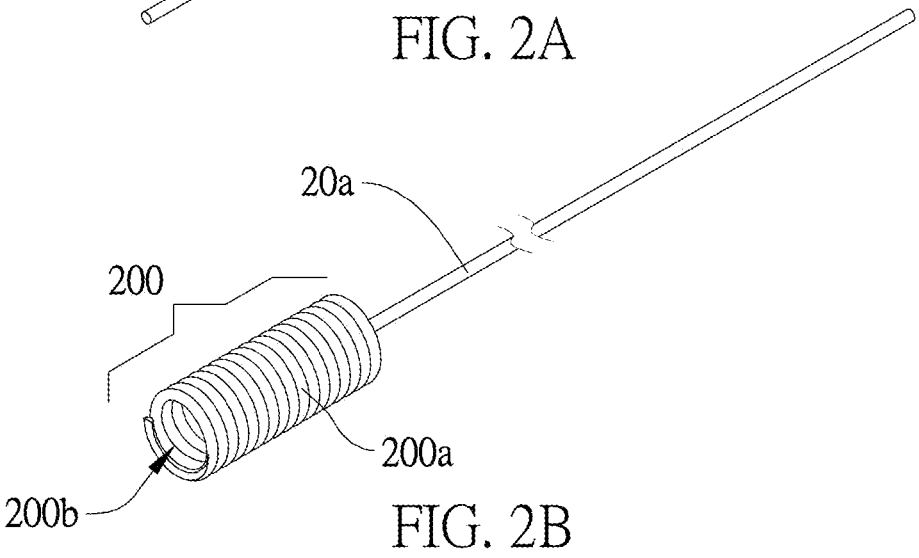

As shown in FIG. 2B, one end of a line segment 20*a* is formed with a spiral portion 200 by joining a plurality of rings 200*a* by winding. A hollow section 200*b* is provided in the spiral portion 200 for receiving other elements (not shown) such as an insert piece.

Figure 2C:
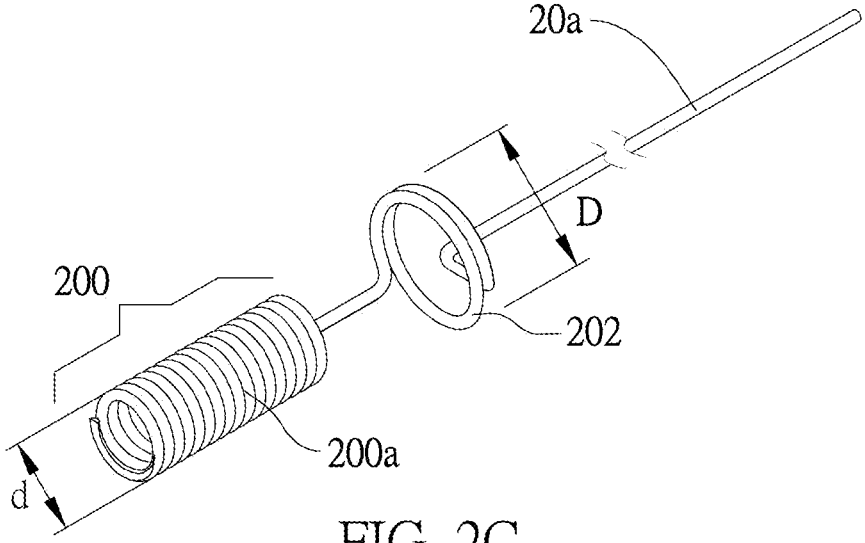

As shown in FIG. 2C, a circular protrusion 202 is formed between two ends of the line segment 20*a* by bending and winding. In this embodiment, the circular diameter of the protrusion 202 is greater than the diameter d of the rings 200*a* of the spiral portion 200. The shape of the protrusion 202 is not limited to this.

Figure 2D:
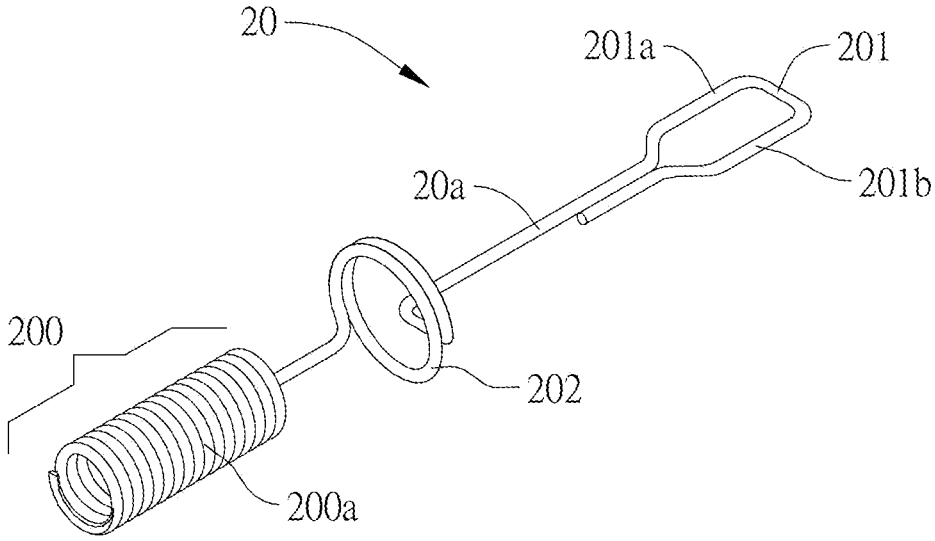

As shown in FIG. 2D, a loop 201 is formed at the other end of the line segment 20*a* by bending, such that the line segment 20*a* forms a conductive rod 20. In this embodiment, separate electrical contact segments 201*a* and 201*b* are provided at the right and left side of the loop 201. The order in which the spiral portion 200, the loop 201 and the protrusion 202 are made can be modified depending on the requirements and there are no specific limits.

The conductive rod 20 of the present invention is formed by winding a line segment 20*a*, so there is no need to remove any material, and no waste material is produced, thus having a lower manufacturing cost compared to the traditional approaches of manufacturing conductors such as stamping or lathe cutting, achieving an objective of the present invention.

Figure 2E:
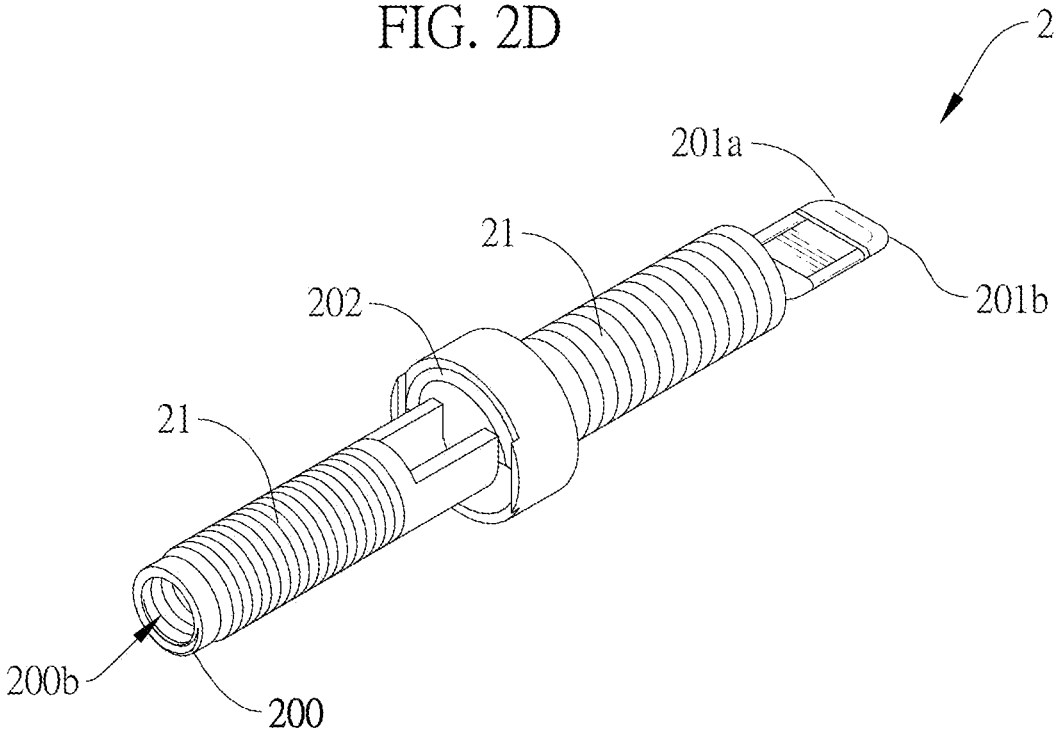

As shown in FIG. 2E, finally, the conductive rod 20 is sheathed by an insulator 21, exposing the upper surfaces of the two electrical contact segments 201*a* and 201*b*, thereby forming a conductive element 2. In this embodiment, the spiral portion 200 is embedded in the insulator 21, and the outermost end of the spiral 200 is exposed from the insulator 21, such that the hollow section 200*b* is exposed. In addition, a portion of the surface of the protrusion is also exposed from the insulator 21.

Furthermore, the outer surface of the insulator 21 may be formed with spiral ridges for connecting with other external devices (not shown).

In addition, the materials of the conductive rod 20 and the insulator 21 can be selected depending on the requirements and there are no specific limits.

The present invention further provides the conductive element 2 shown in FIGS. 2D and 2E, which may include a conductive rod 20 integrally formed by a single line segment 20*a* and an insulator 21 sheathing the conductive rod 20. The conductive rod 20 has one end that is formed with a spiral portion 200 by joining a plurality of rings 200*a*, and the other end that is formed with a loop 201 with two separate electrical contact segments 201*a* and 201*b*, and a circular protrusion 202 is formed between the two ends of the conductive rod 20.

The two electrical contact segments 201*a* and 201*b* are exposed from the insulator 21.

Since the conductive rod 20 of the present invention is integrally formed by a single line segment 20*a*, the weight of the conductive rod 20 is reduced and is more advantageous for shipping.

Figure 3A:
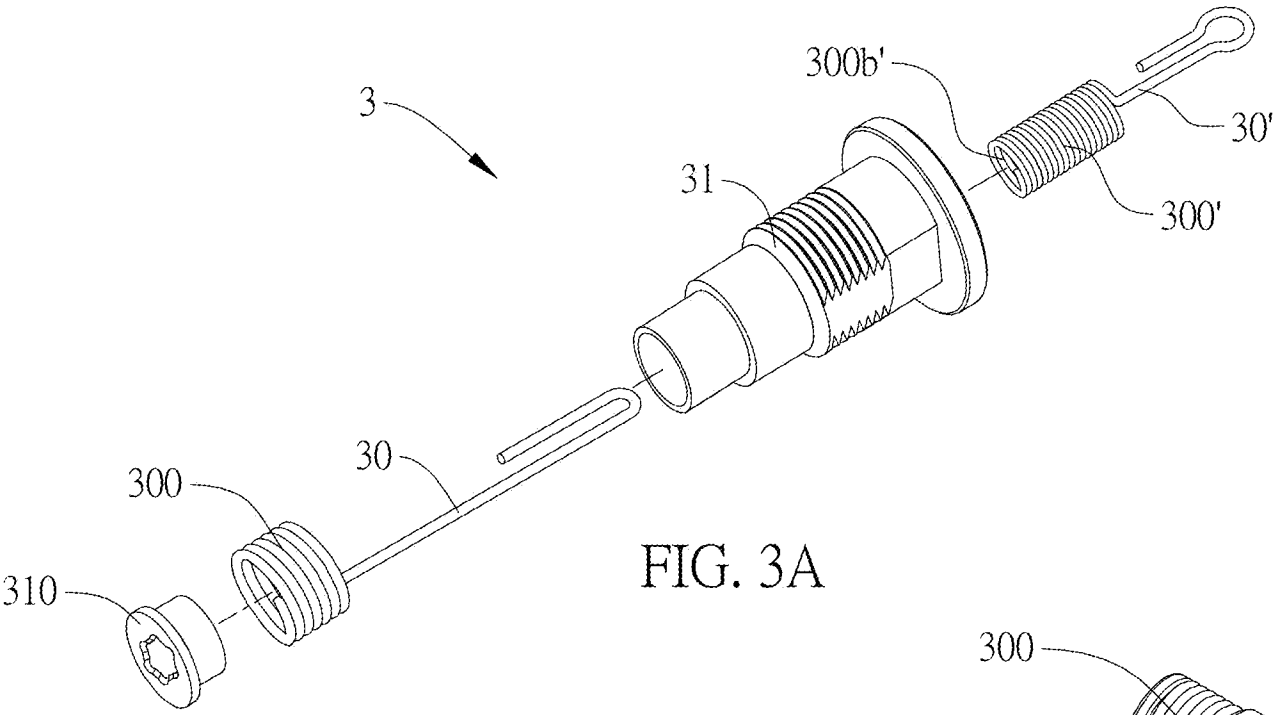
FIG. 3A is an exploded diagram showing a conductor according to another embodiment of the present invention.
Figure 3B:
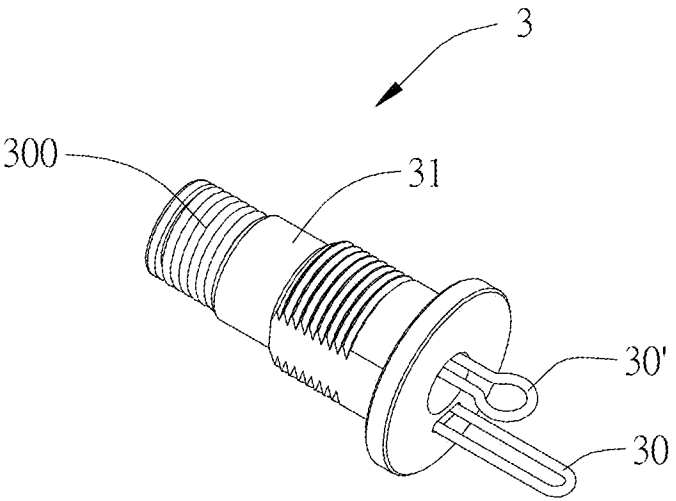
FIG. 3B is a perspective diagram showing the conductor according to another embodiment of the present invention.

Referring to FIGS. 3A and 3B, a conductive element 3 according to another embodiment of the present invention is shown. The main difference between this embodiment and the above embodiment is in the number of the conductive rods, their structures and manufacturing methods are similar, and will not be repeated.

The conductive element 3 is applied to a RAC socket. The conductive element 3 has two conductive rods 30 and 30', and one of the spiral portions 300 is exposed from the insulator 31, while the other spiral portion 300' is embedded in the insulator 31. Furthermore, the insulator 31 has a cap 310 for covering the hollow section 300*b'* of the spiral portion 300' in the insulator 31.

The above embodiments are only used to illustrate the principles of the present invention, and they should not be construed as to limit the present invention in any way. The above embodiments can be modified by those with ordinary skill in the art without departing from the scope of the present invention as defined in the following appended claims.

What is claimed is:

1. A conductive element, comprising:

a conductive rod integrally formed by a single line segment and having one end that is a spiral portion formed by joining a plurality of rings, and the other end that is a loop, wherein each of the plurality of rings has the same area, and the plurality of rings are aligned and stacked; and an insulator encasing the conductive rod and the loop protruding from the insulator such that the insulator exposes the loop.

2. The conductive element of claim 1, wherein the number of the conductive rod is one or more.

3. The conductive element of claim 1, wherein the spiral portion is exposed from the insulator or embedded in the insulator.

4. The conductive element of claim 1, wherein the loop has two separate electrical contact segments.

5. The conductive element of claim 4, wherein the two electrical contact segments are exposed from the insulator.

6. The conductive element of claim 1, wherein a protrusion is further provided between the two ends of the conductive rod.

7. The conductive element of claim 6, wherein the protrusion is circular.

8. A method for manufacturing a conductive element, comprising:

providing a line segment made of a conductive material;

forming a spiral portion at one end of the line segment by joining a plurality of rings by winding, and forming a loop at the other end thereof by bending, so that the line segment forms a conductive rod, wherein each of the plurality of rings has the same area, and the plurality of rings are aligned and stacked; and encasing an insulator around the conductive rod and the loop protruding from the insulator such that the insulator exposes the loop.

9. The method of claim 8, wherein the number of the conductive rod is one or more.

10. The method of claim 8, wherein the spiral portion is exposed from the insulator or embedded in the insulator.

11. The method of claim 8, wherein the loop has two separate electrical contact segments.

12. The method of claim 11, wherein the two electrical contact segments are exposed from the insulator.

13. The method of claim 8, further comprising forming a protrusion between the two ends of line segment by bending while forming the conductive rod.

14. The method of claim 13, wherein the protrusion is circular.

* * * * *